US007758155B2

(12) United States Patent
Anagnostopoulos

(10) Patent No.: US 7,758,155 B2
(45) Date of Patent: Jul. 20, 2010

(54) MONOLITHIC PRINTHEAD WITH MULTIPLE ROWS OF INKJET ORIFICES

(75) Inventor: Constantine N. Anagnostopoulos, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 536 days.

(21) Appl. No.: 11/748,620

(22) Filed: May 15, 2007

(65) Prior Publication Data

US 2008/0284818 A1 Nov. 20, 2008

(51) Int. Cl.
*B41J 2/15* (2006.01)
*B41J 1/145* (2006.01)

(52) U.S. Cl. ..... 347/40; 347/77; 347/82; 347/89

(58) Field of Classification Search ..... 347/3, 347/20, 33, 34, 36, 40–43, 47, 77, 79, 82, 347/85–87, 89–90
See application file for complete search history.

(56) References Cited

U.S. PATENT DOCUMENTS 4,460,903 A 7/1984 Guenther et al.
5,475,409 A 12/1995 Simon et al.
5,501,893 A 3/1996 Laermer et al.
5,880,759 A 3/1999 Silverbrook
6,017,112 A * 1/2000 Anderson et al. ..... 347/40
6,051,503 A 4/2000 Bhardwaj et al.
6,079,821 A 6/2000 Chwalek et al.
6,234,620 B1 5/2001 Faisst, Jr. et al.
6,382,782 B1 5/2002 Anagnostopoulos et al.
6,439,703 B1 8/2002 Anagnostopoulos et al.
6,450,619 B1 9/2002 Anagnostopoulos et al.
6,497,510 B1 12/2002 Delametter et al.
6,536,883 B2 * 3/2003 Hawkins et al. ..... 347/77
6,554,410 B2 4/2003 Jeanmaire et al.
6,663,221 B2 12/2003 Anagnostopoulos et al.
6,866,370 B2 3/2005 Jeanmaire
6,984,028 B2 1/2006 Steiner
6,986,573 B2 * 1/2006 Silverbrook et al. ..... 347/101
7,004,565 B2 * 2/2006 Suzuki et al. ..... 347/50
7,533,965 B2 5/2009 Steiner
2002/0113849 A1 8/2002 Hawkins et al.
2006/0197810 A1 9/2006 Anagnostopoulos et al.
2008/0316278 A1 * 12/2008 Van Den Bergen ..... 347/65

FOREIGN PATENT DOCUMENTS

DE 42 41 045 12/1992

OTHER PUBLICATIONS

U.S. Appl. No. 11/687,873, filed Mar. 19, 2007, Brost et al., "Aerodynamic Error Reduction for Liquid Drop Emitters".
Miki et al., "Multi-stack Silicon-direct Wafer Bonding for 3D MEMS Manufacturing," 2003 Elsevier Science B.V., US.
Miki, et al., "A Studyof Multi-Stack Silicon-Direct Wafer Bonding for MEMS Manufacturing," 2002 IEEE, US.

* cited by examiner

*Primary Examiner*—Thinh H Nguyen
(74) *Attorney, Agent, or Firm*—William R. Zimmerli

(57) ABSTRACT

An inkjet apparatus and method are provided. The inkjet printing apparatus includes a dual row of ink orifices in an integral inkjet printhead. The method provides ink streams with more nozzles per inch in the widthwise direction on a paper without alignment problems and without the need to utilize very small droplets of ink.

25 Claims, 12 Drawing Sheets

MONOLITHIC PRINTHEAD WITH MULTIPLE ROWS OF INKJET ORIFICES

FIELD OF THE INVENTION

This invention relates generally to the field of digitally controlled continuous ink jet printing devices, and in particular to continuous ink jet printheads having a plurality of rows of ink jet orifices.

BACKGROUND OF THE INVENTION

U.S. Pat. No. 6,079,821 issued to Chwalek et al. discloses a continuous ink jet printhead in which deflection of selected droplets is accomplished by asymmetric heating of the jet exiting the orifice.

U.S. Pat. No. 6,554,410 by Jeanmaire et al. teaches an improved method of deflecting the selected droplets. This method involves breaking up each jet into small and large drops and creating an air or gas cross flow relative to the direction of the flight of the drops that causes the small drops to deflect into a gutter or ink catcher while the large ones bypass it and land on the medium to write the desired image or the reverse, that is, the large drops are caught by the gutter and the small ones reach the medium.

U.S. Pat. No. 6,450,619 to Anagnostopoulos et al. discloses a method of fabricating nozzle plates, using CMOS and MEMS technologies which can be used in the above printhead. Further, in U.S. Pat. No. 6,663,221, issued to Anagnostopoulos et al, methods are disclosed of fabricating page wide nozzle plates, whereby page wide means nozzle plates that are about 4" long and longer. A nozzle plate, as defined here, consists of an array of nozzles and each nozzle has an exit orifice around which, and in close proximity, is a heater. Logic circuits addressing each heater and drivers to provide current to the heater may be located on the same substrate as the heater or may be external to it.

For a complete continuous ink jet printhead, besides the nozzle plate and its associated electronics, a means to deflect the selected droplets is required, an ink gutter or catcher to collect some of the droplets, an ink recirculation or disposal system, various air and ink filters, ink and air supply means and other mounting and aligning hardware are also needed.

In these known continuous ink jet printheads, the nozzles in the nozzle plates are arranged in a straight line and for robust operation and manufacturability, they are spaced at most as close as about 42.33 microns apart, which corresponds to about 600 nozzles per inch. Drop volumes produced by these nozzle arrays depend on the diameter of the exit orifice of the nozzles and the velocity of the jet. Typical volumes range from a few picoliters to many tens of picoliters.

As already mentioned, all continuous ink jet printheads, including those that depend on electrostatic deflection of the selected droplets (see for example U.S. Pat. No. 5,475,409 issued to Simon et al), an ink gutter or catcher is needed to collect the unselected droplets. Such a gutter has to be carefully aligned relative to the nozzle array since the angular separation between the selected and unselected droplets is, typically, only a few degrees. The alignment process is typically a very laborious procedure and increases substantially the cost of the printhead. The printhead cost is also increased because each gutter must be aligned to its corresponding nozzle plate individually and one at a time.

The gutter or catcher may contain a knife-edge or some other type of edge to collect the unselected droplets, and that edge has to be straight to within a few tens of microns from one end to the other. Gutters are typically made of materials that are different from the nozzle plate and as such they have different thermal coefficients of expansion so that if the ambient temperature changes the gutter and nozzle array can be in enough misalignment to cause the printhead to fail. Since the gutter is typically attached to some frame using alignment screws, the alignment can be lost if the printhead assembly is subjected to shock as can happen during shipment. If the gutter is attached to the frame using an adhesive, misalignment can occur during the curing of the glue as it hardens, resulting in yield loss of printheads during their assembly.

The US publication 2006/0197810 A1-Anagnostopoulos et al. discloses an integral printhead member containing a row of inkjet orifices.

There's a need to accurately print with inkjet streams closer together widthwise on paper than is presently possible. Rows of inkjet's are limited in how close they can be together by the necessity for separation between ink droplets from adjacent orifices. The spacing between rows of inkjets in the machine direction is limited by the large space mounting requirements for a second row of inkjets. Therefore, a second row of 600 nozzles per inch inkjets cannot be arranged to overlap earlier printed material at 600 nozzles per inch in alignment, as the paper is not stable enough after wetting by the first inkjet in the first row to align, within 20 micrometers, with a second row of jets. Accurate alignment with the pattern from the first row after the distance of several centimeters the paper has traveled to the second row of nozzles is not possible. Further aligning the jets themselves is difficult to achieve and to maintain. If a second row of nozzles could be aligned to print between the ink from the nozzles of the first row a greater density of nozzles per width inch on paper could be achieved.

There is a need for a method of providing ink streams from more nozzles per inch in a widthwise direction to paper beneath the ink streams than has heretofore been possible without alignment problems and without the need to utilize very small droplets of ink. There is a need for an arrangement where a second row of nozzles is aligned to a first printhead and maintains this alignment during operation and is so close to the first printhead that paper stretching is not in issue

SUMMARY OF THE INVENTION

It is an object of the invention to overcome disadvantages of prior practices.

It is another object of the invention to provide the ability to form higher-quality inkjet prints.

It is a further object of the invention to provide more accurate placement of successive ink streams to a paper.

These and other advantages of the invention are provided by an inkjet printing apparatus comprising a dual row of ink orifices in an integral inkjet.

The invention provides a method of providing ink streams with more nozzles per inch in the widthwise direction on a paper than has been possible without alignment problems and without the need to utilize very small droplets of ink. There is provided an arrangement where a second printhead is aligned to a first printhead and maintains this alignment during operation and is so close to the first printhead that paper stretching is not in issue.

DETAILED DESCRIPTION OF THE INVENTION

The invention has many advantages over prior practices, apparatus and methods for inkjet printing. The invention provides higher-quality images as it is possible to have a density of up to 1200 nozzles per inch across the width of the paper without requiring extremely small ink droplets. With this number of nozzles a high-quality print is possible. Further, it is possible in the embodiment where the orifices are aligned with the direction of recording medium movement, for example, paper movement, when printing with or during the operation of the apparatus of the invention to deliver higher print speed. Further, in the embodiment where the orifices are aligned with paper movement, if one of two aligned orifices is plugged there is less deterioration in quality than if only one orifice was present to start with. Further, image quality is improved as the rows of nozzles are separated by only a small distance, and stay in alignment. Therefore, ink drops will not collide in the air prior to reaching the paper as the individual nozzles in each row of nozzles are separated sufficiently such that the drops are widely spaced as they are ejected from the nozzles. The collision of ink drops in the air prior to reaching the paper results in a poor quality image. Splay effects can be reduced when the droplets are sufficiently far apart. For example, a single array 600 npi device can be replaced with a dual 300 npi device such that adjacent drops are 84.66 microns apart rather than 42.33 microns apart so that the aerodynamic effects that lead to splay are reduced. Another invention advantage is that ink drops of about 4 pico liters may be utilized for efficient delivery of more ink than if smaller drops were required because of close nozzle spacing. These and other advantages will be apparent from the discussion below.

Figure 1A:
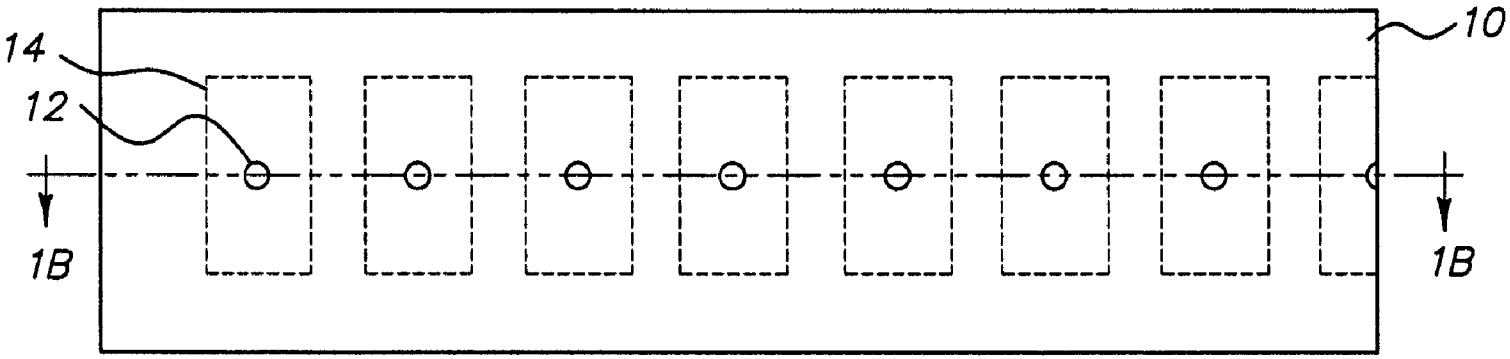
FIGS. 1A and 1B are schematic partial cross-sections of a 600 nozzles per inch inkjet head.
Figure 1B:
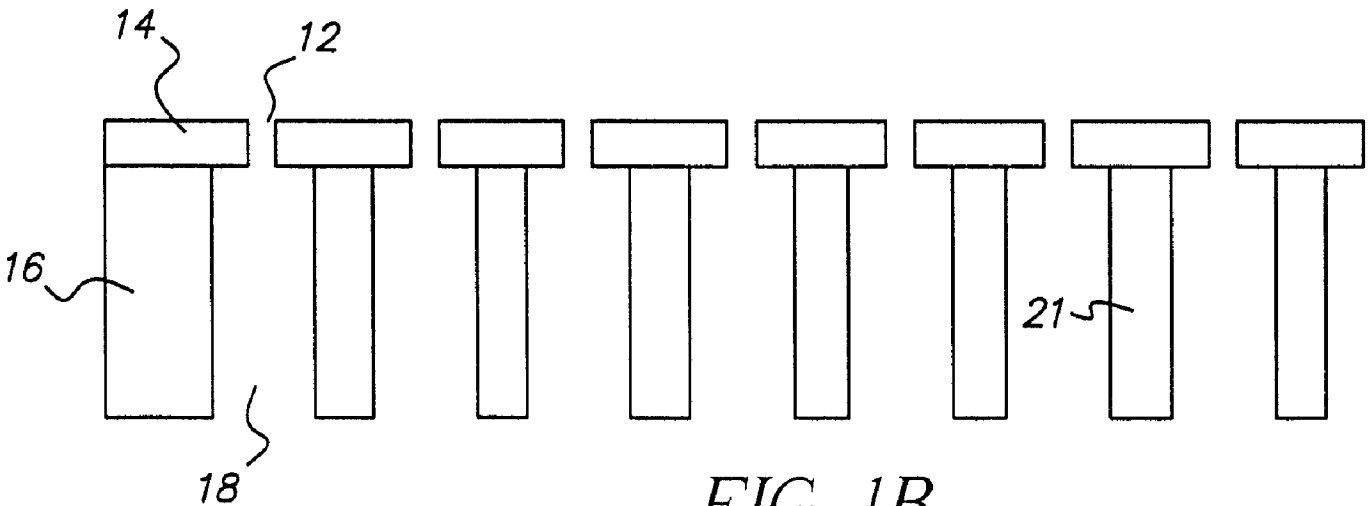
Figure 2:
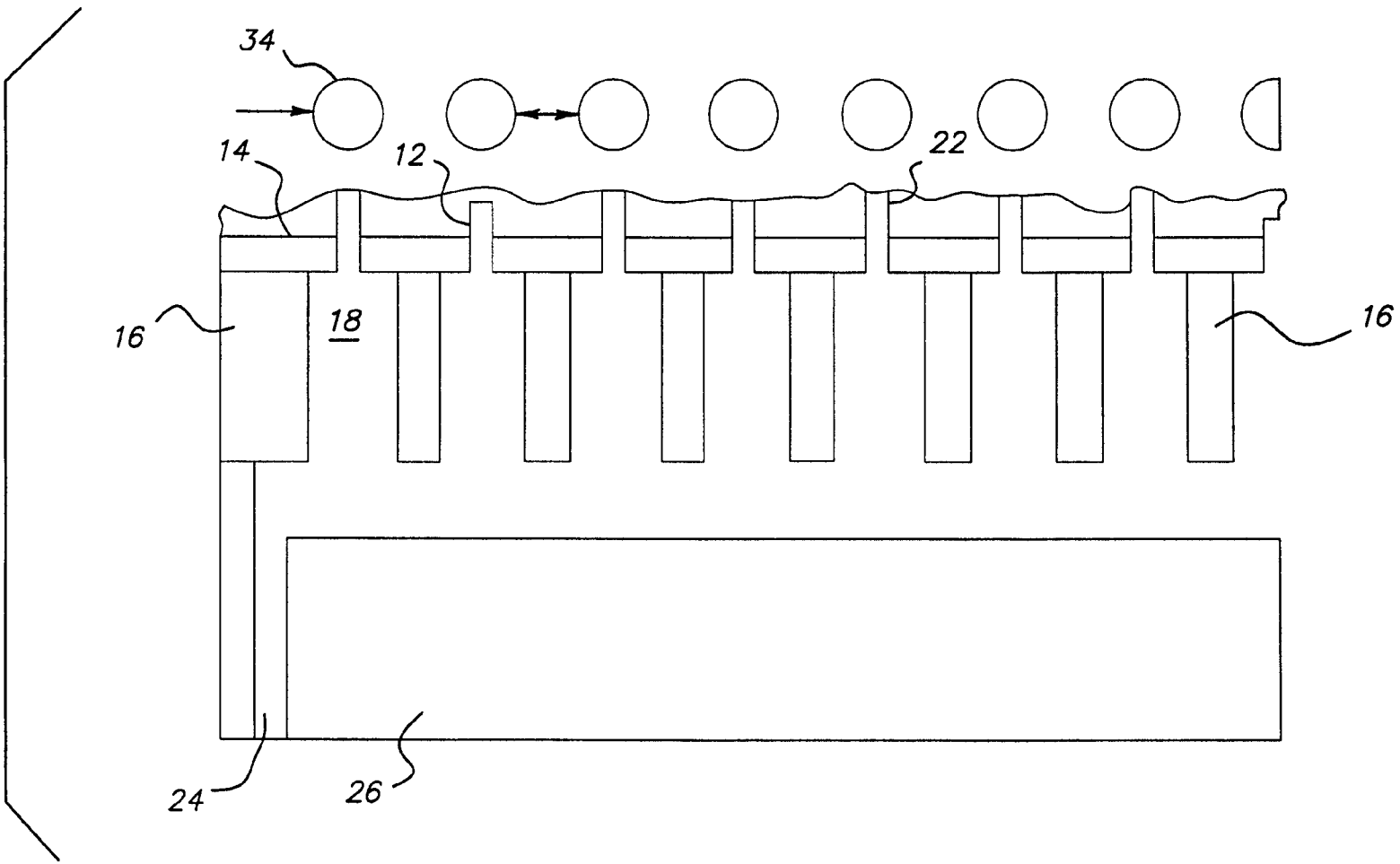
FIG. 2 is a cross-sectional view showing the relative droplet positions for a 600 nozzle per in printhead.

In FIGS. 1A and 1B, and FIG. 2 there is shown the architecture of a continuous inkjet stream nozzle plate 10. The plate comprises a membrane 14 with orifices 12 numbered 1 through 7. The heaters around each nozzle 12, the logic circuits, and drivers are not shown. For a 600 nozzle per inch spacing the distance between nozzles (pitch) is about 42.3 μm. The bores of nozzles 12 are about 10 μm. In FIG. 1B a cross-section on line B-B of FIG. 1A is shown. The dialectic membrane 14 includes grown and deposited layers on top of the silicon substrate 16. The dielectric membrane 14 is about 2 microns thick, though it can range in thickness from about 1 to 10 microns and the ink channels 18 are separated by bridges or cross bars 21 of about 10 μm in thickness.

Illustrated in FIG. 1A and FIG. 1B, and FIG. 2 are print heads where the issues that can arise when attempting to decrease the spacing of nozzles to less than that required for about 600 nozzles per inch are illustrated. As seen in FIG. 2 a nozzle plate has been brought into contact with a manifold 26 normally stainless steel. Ink 32 enters the manifold as a pressurized fluid at 24 and enters channels 18 leading to the bores 12. The ink exits from the bores 12 as the jet stream 22. It breaks into droplets 34. As shown in FIG. 2 the bores 12 form orifices that are emitting ink in droplets 34 that have a diameter of about 20 μm. The spacing between the droplets is about 22 micrometers. Therefore, if the pitch of the bore orifices was changed from the spacing of about 42.3 μm apart for 600 nozzles per inch to a spacing of about 21 μm pitch for a 1200 nozzles per inch spacing the droplets having a diameter about 20 micrometers would touch and intermingle causing poor print quality. One suggested solution to this problem is to offset 2 successive 600 nozzles per inch print heads in the machine (paper) direction by about 22 μm in the width of the direction of printing such that they have an effective printing density of about 1200 nozzles per inch. However, the alignment of successive printheads is difficult and further the paper is not stable over the distance between the nozzles as it becomes wet from the first nozzle row printing. Therefore, it is really impossible to both effectively mechanically align successive printheads with accuracy and maintain this accuracy during use. The mechanical requirements for mounting successive print heads in the paper direction has generally required a spacing of successive print heads of between 2 and 8 centimeters.

Figure 3A:
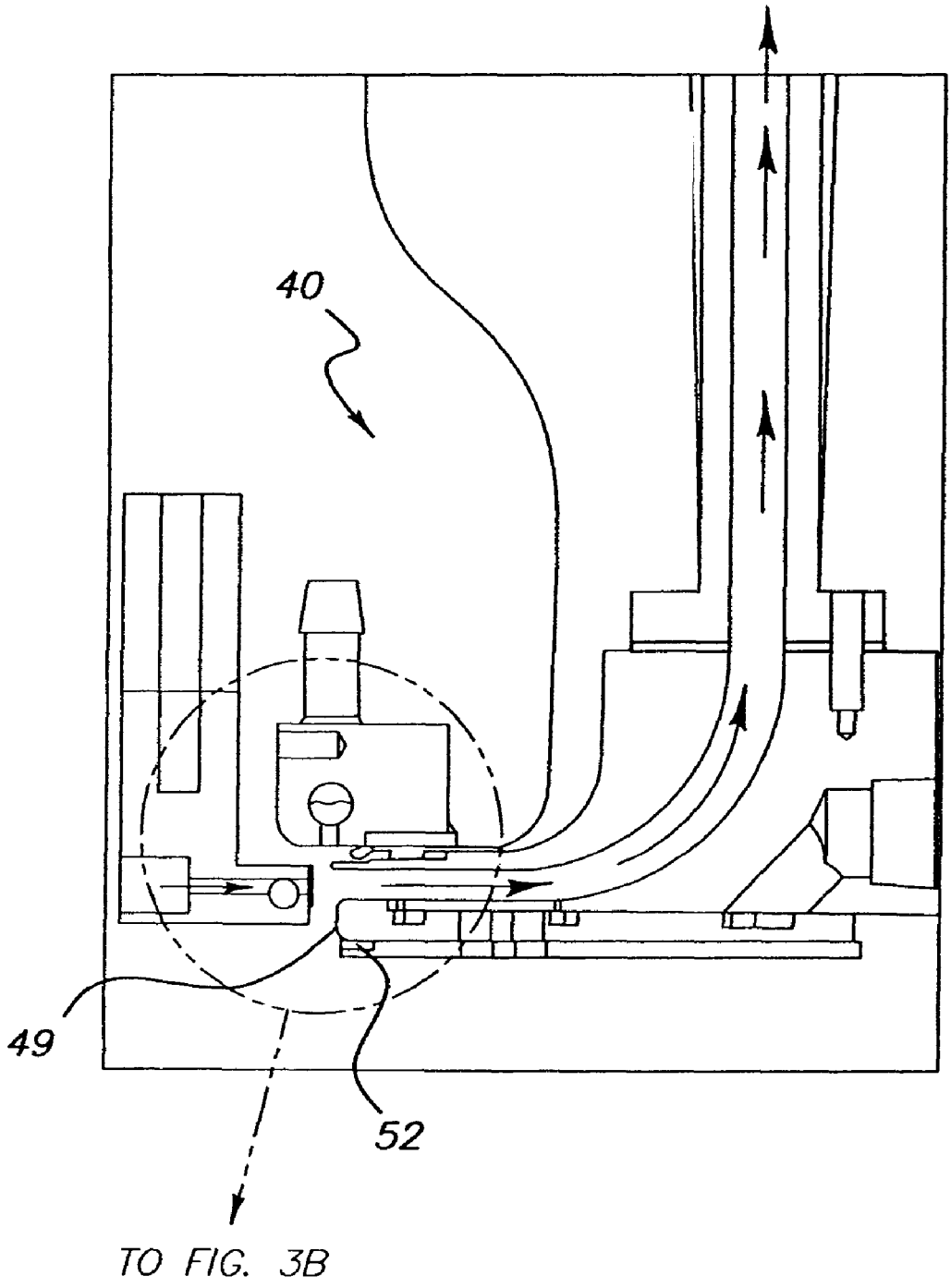
FIG. 3A (PRIOR ART)
FIG. 3 is a schematic with an enlargement of a prior art printhead showing the gutter and droplet deflection into the gutter.
Figure 3B:
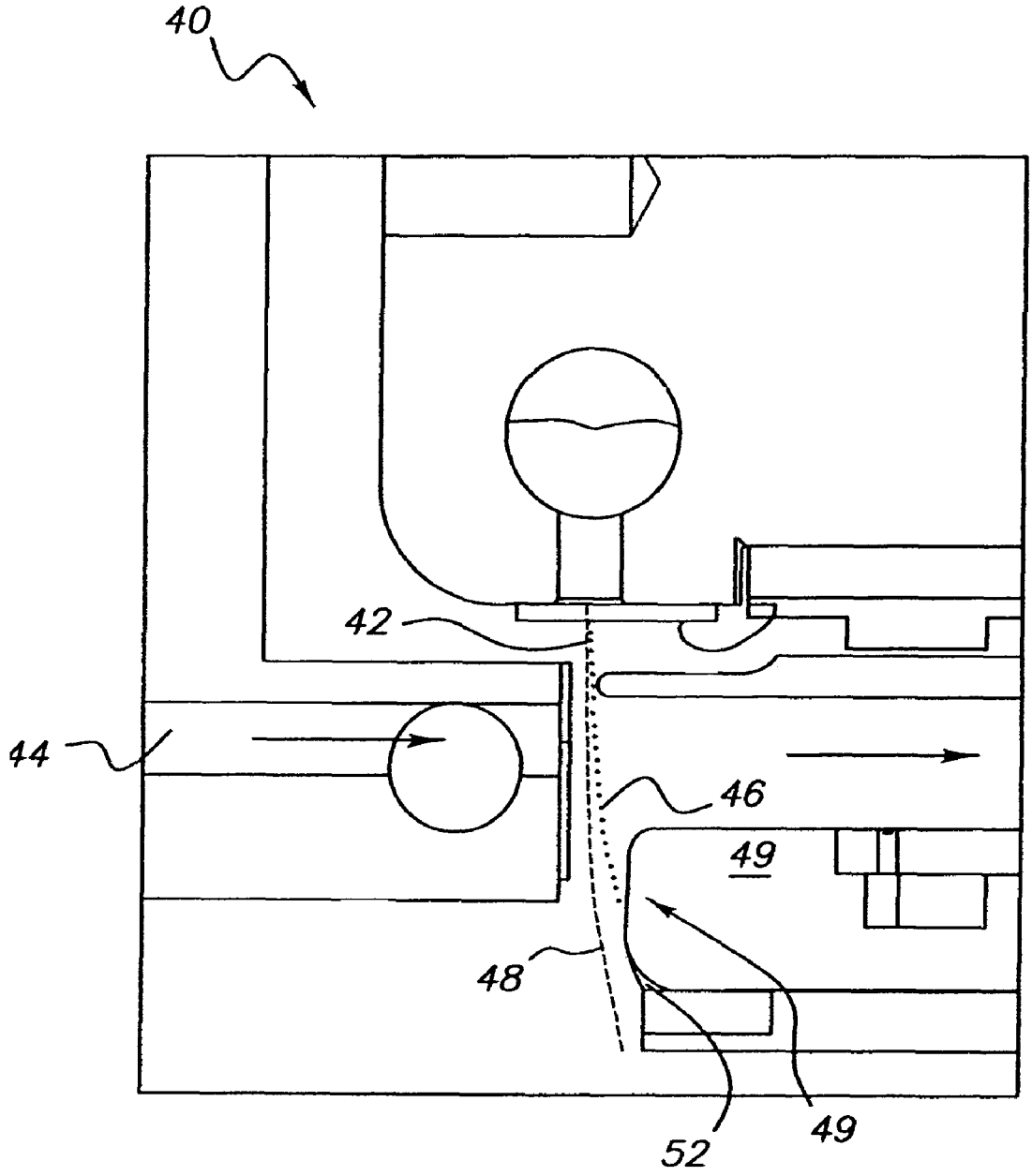
FIG. 3B (PRIOR ART)

In FIGS. 3A and 3B there is illustrated a printhead 40 with a gutter arrangement of the prior art. In this arrangement the printhead drops in stream 42 are moved by a directional airstream 44 such that the smaller drops 46 are deflected by the airstream 44 into the outer surface of a Coanda catcher 49 for capture. The larger drops 48 are deflected less and continue out of the printhead on to the printing surface, not shown. The ink comprising the smaller drops flows along the catcher 49 and is withdrawn by capillary action and suction 52 and preferably recycled. As can be seen this type of printing with an ink catcher as shown requires quite a bit of tool adjustment and space. It is also known to use a knife edge or an angled member as a catcher for a gutter.

Figure 4A:
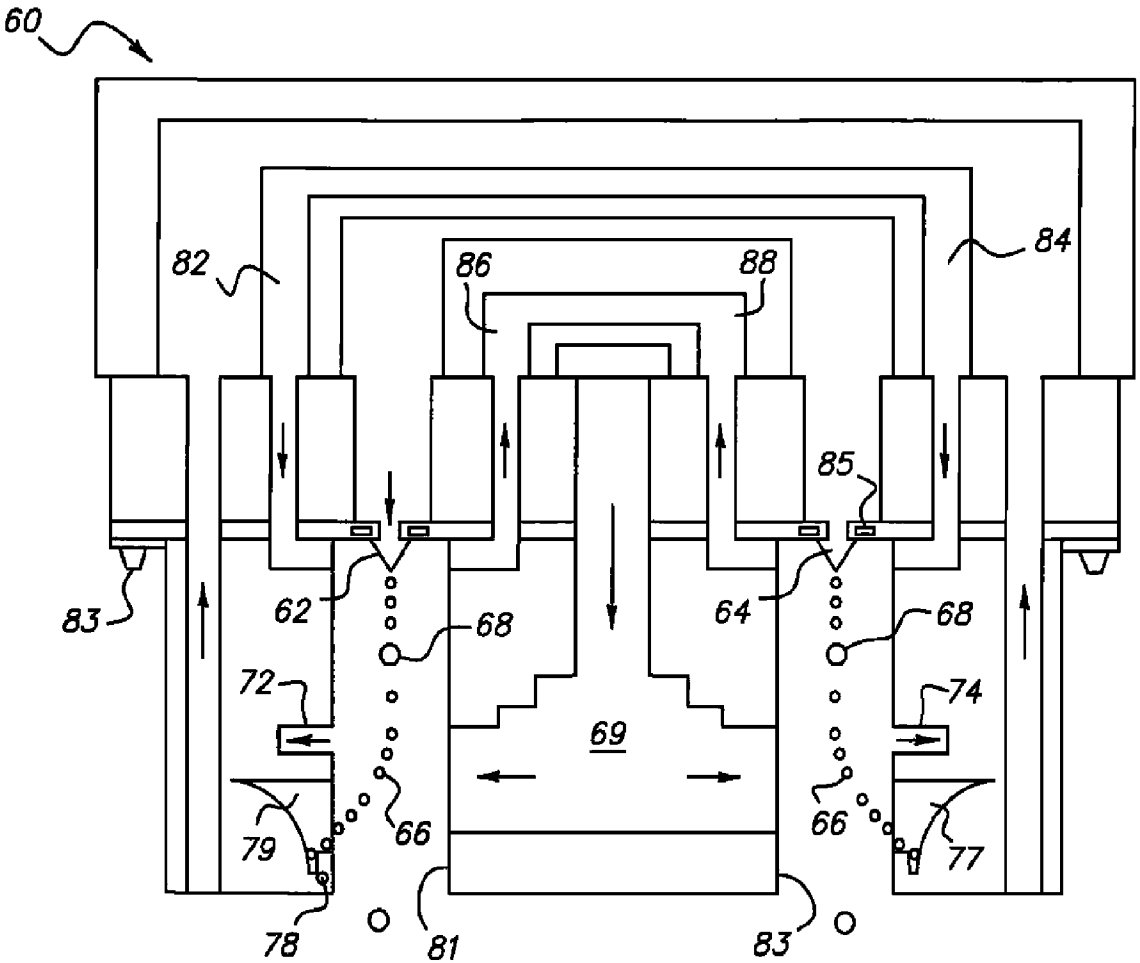
FIG. 4A is a cross-sectional view of the dual gutter printhead of the invention.

In FIG. 4A is illustrated schematically in cross-section a dual gutter and dual orifice inkjet head 60 of the invention. The monolithic integral structure comprises silicon wafers attached and integrally joined together to form an integral monolithic structure. The printhead has 2 orifices 62 and 64 for inkjet ejection. The nozzles expel ink drops of small size 66 and large ink drops 68. The larger drops are the useful ones for forming a high-quality images. The printhead 60 contains a channel 69 for deflection air. The channel 69 supplies deflection air in opposite directions to the ink droplets exiting orifices 62 and 64. Deflection air exits, after deflection of smaller drops into separate channels 72 and 74. The smaller drops 66 to be removed are directed to the gutter 79. The droplets are caught by the straight edge 78 and are withdrawn by the gutters 79 and 77. The gutters provide a capillary action and suction to remove the ink and carry it to a tank for recirculation. Collinear air to entrain the ink drops is brought in through ducts 82 and 84. These same ducts for the collinear air entrance and exit are also utilized for application of washing solvent by means not shown to the nozzles and for removal of the solvent. The other air and fluid ducts can also be employed in the hands free cleaning process. It is noted that the nozzles are provided with heaters 85 to control the drop size. As shown in FIG. 4A the printhead of the invention provides very compact arrangement of heads in the machine direction as they are both formed on the same monolithic silicon member. The heads share air supplies and vacuum supplies as well as ink supplies. The air for deflection is provided between the nozzles and steers the small ink drops not to be utilized for printing to the outside of the printhead opening into gutters 79 and 77. When in use the printhead is fastened to a manifold, not shown, for supply of the liquids and gases. Points 83 represent wire bonding sites for electrical connections to the on chip electronics. It is noted that the provision for the conventional attachments to a printhead for the usual operating of an inkjet printer have not illustrated and drawn. However the control of the electronics for nozzle operation, provision for ink recycling, and the regulation of airflow for collinear air and deflection air are well known in the arts and well treated in inkjet patents and patent publications such as US2006/0197810 A1 by Anagnostopoulos et al, and U.S. Pat. No. 7,152,964, U.S. Pat. No. 6,899,410 and U.S. Pat. No. 6,863,385 by Jeanmaire.

Figure 4B:
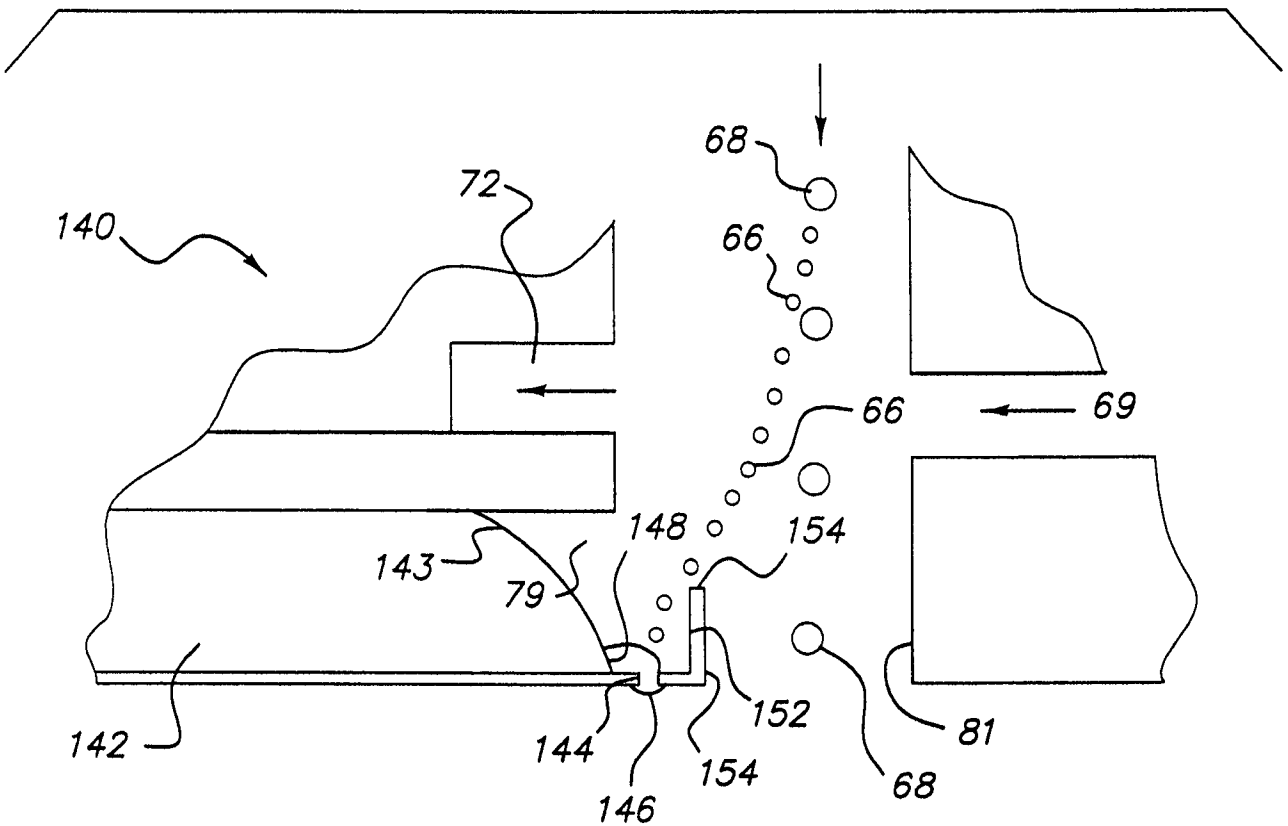
FIG. 4B as a partial cross-sectional view of the gutter area of a printhead in accordance with the invention.

In FIG. 4B is shown an alternative structure for the exit opening of the printhead of FIG. 4. The alternative arrangement 140 is shown for opening 81 although of course, in use, a mirror image gutter arrangement would also be utilized for the opening 83 in FIG. 4B. As shown in FIG. 4B the end of the gutter has a narrow integrally formed wall or knife edge 152 to catch the drops 66 that are not intended to issue from the printhead onto the paper. The gutter has ink 142 that has a meniscus 143 on the end towards the wall 152. The bottom of the gutter below the wall 152 is provided with an opening 144 to suck in ink that has hit the outside of the wall 154 and run down to the bottom of printhead 140 where the excess ink 146 will be sucked in through opening 144 and join the ink liquid 142 the ink from the bottom of the gutter is shown moving to the meniscus 143 by ink 148. The wall 152 is formed integrally with the layer of silicon etched to form the gutter. The preferred DRIE etching process is able to form vertical walls such as 152 with extreme accuracy. The wall typically would have a top width 154 of between 5 and 25 μm wide. The top 154 of wall 152 would be flat. The wall would have a depth of between 50 and 300 μm and be extended the length of the printhead.

Figure 4C:
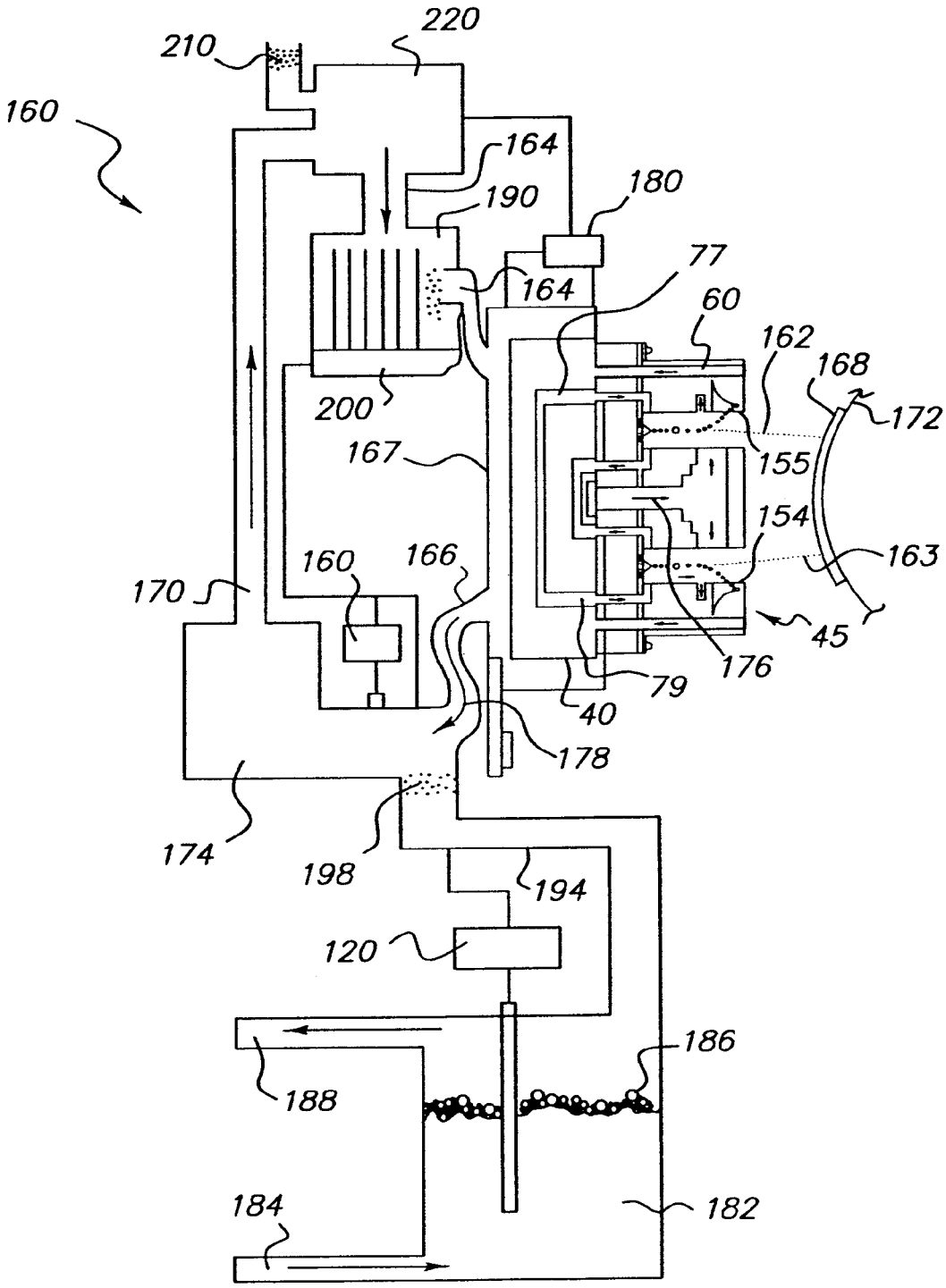
FIG. 4C is a schematic illustration of a printing system using the printhead of the invention.

Referring to FIG. 4C, a printing apparatus used in a preferred implementation of the current invention is shown schematically utilizing the printhead of FIG. 4A. The printer 160 includes an integral deflector gutter walls 154 and 154 integrally formed as a part of the ink-jet nozzle array 81 and 83. Large volume ink droplets 68 and small volume ink droplets 66 are formed from ink ejected from the ink-droplet-forming-printhead 60. Large droplets 68 are emitted along ejection stream paths 162 and 163. The integral gutter structures 77 and 79 includes an inlet plenum 164 and an outlet plenum 166 for directing a gas through integral deflector gutter structure and against the ink droplets for separating the different size ink droplets. A manifold 167 is attached to printhead 60 to channel all fluids to and from the integral silicon printhead. The integral deflector gutter structures 79 and 77 also include a droplet wall 154 that is positioned adjacent to an outlet plenum. The purpose of wall 12 is to intercept the displaced small droplets 66, while allowing large ink droplets 68 traveling along droplet paths 162 and 163 to continue on to the recording media 168 carried by print drum 172. Vacuum pump 174 communicates with plenum 166 and provides a sink for the gas flow 178. The application of force due to gas flow 176 separates the ink droplets into small-drop path and a large-drop path. Pump 220 draws in air, while filter 210 removes dust and dirt particles.

Ink recovery conduits/passageways 79 and 77 are connected to outlet plenum 166 of the integral wall gutter structure for receiving droplets recovered by knife edges 154 and 155. Ink recovery conduits 77 and 78 communicate with ink recovery reservoir 182 to facilitate recovery of non-printed ink droplets by an ink return line 184 for subsequent reuse. Ink recovery reservoir 182 contains open-cell sponge or foam 186, which reduces or even prevents ink sloshing. A vacuum conduit 188, coupled to a negative pressure source, can communicate with ink recovery reservoir 182 to create a negative pressure in ink recovery conduit 166 improving ink droplet separation and ink droplet removal. The gas flow rate in ink recovery conduit 166, however, is chosen so as to not significantly perturb the large droplet path. Lower plenum 166 is fitted with a filter 192 and a drain 194 to capture any ink fluid resulting from ink misting, or misdirected jets which has been captured by the air flow in plenum 166. Captured ink is then returned to recovery reservoir.

Additionally, a portion of plenum 164 diverts a small fraction of the gas flow from pump 220 and conditioning chamber 190 to provide a source for the gas which is drawn into ink recovery conduit 166 and into gas recycling line 170. The gas pressure at 69 and in ink recovery conduit 166 are adjusted in combination with the design of ink recovery conduit 166 and plenum 164 so that the gas pressure in the printhead assembly near integral gutter structure 155 and 154 is positive with respect to the ambient air pressure near print drum 172. Environmental dust and paper fibers are thusly discouraged from approaching and adhering to integral wall 78 and are additionally excluded from entering ink recovery conduit 166.

In operation, a recording medium 168 is transported in a direction transverse to axis 162 and 163 by print drum 172 in a known manner while the printhead/nozzle array mechanism remains stationary. This can be accomplished using a controller, not shown, in a known manner. Recording media 168 may be selected from a wide variety of materials including paper, vinyl, cloth, other fibrous materials, etc.

The recovery air plenum 72 and 74 of integral gutter structures 154 and 155 are integrally formed on nozzle array 60. In the preferred embodiment, an orifice cleaning system, not shown, may also be incorporated into collinear air structure 24. Cleaning would be accomplished by flooding the nozzle array 62 and 64 with solvent injected through structure 82 and 84. Used solvent is removed by drawing vacuum on the cleaning solvent through output ports 86 and 88. All other integral inlets and outlets may additionally be utilized in the hands free cleaning process.

In the present invention the guttering structure is integrally formed with nozzle array 62 and 64. This is done in order to maintain accuracy between the ink jet nozzles 62 and 64 and the wall or knife edge. In a preferred embodiment of the present invention, nozzle array 62 and 64 is formed from a semiconductor material (silicon, etc.) using known semiconductor circuit (CMOS), and micro-electro mechanical systems (MEMS) fabrication techniques, etc. Such techniques are illustrated in U.S. Pat. Nos. 6,663,221 and 6,450,619 which are hereby incorporated by reference in their entirety. However, it is specifically contemplated and therefore within the scope of this disclosure that nozzle array may be integrally formed with the gutter structure made from any materials using any fabrication techniques conventionally known in the art.

Figure 5:
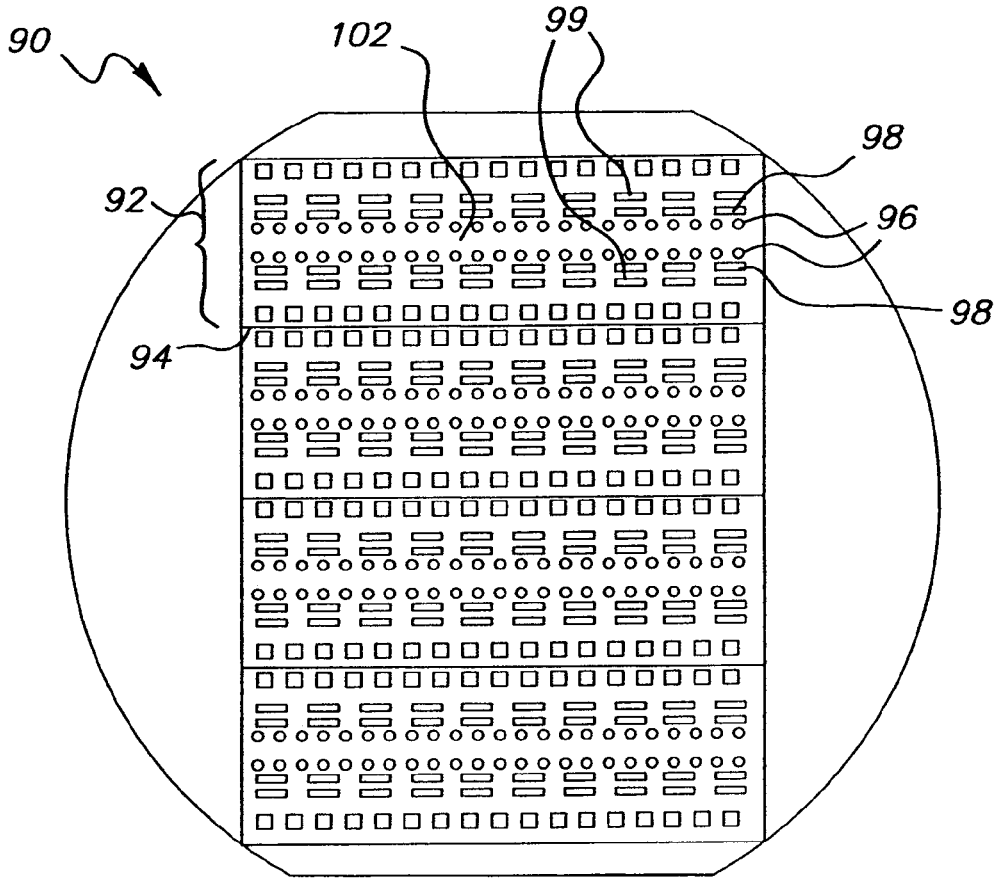
FIG. 5 is a schematic representation of four dual integral gutter devices on a single silicon wafer.

In FIG. 5. there is representation of four dual integral gutter devices on a single silicon wafer 90. Bracket 92 indicates a single dual integral gutter device that may be separated from the chip on cut line 94. The wafer containing the printheads is presented, in the drawings, in such a manner that the rows of orifices 96 are exposed. The other parts of the wafer 90 are within the chip but indicated on the schematic representation. Channels 98 represents the channels for the collinear air to go in and out and for the cleaning solvent to go in and out. Ink returns 99 provide a path from the gutter to the ink supply, not shown. The channels for the deflection air to go in to the wafer are indicated by 102.

The dual integral gutter device of the invention may be formed by any of the known techniques for shaping silicon articles. These include CMOS circuit fabrication techniques, micro-electro-mechanical systems fabrication techniques (MEMS) and others. The preferred technique has been found to be the deep reactive ion etch (DRIE) because this process provides for deep anisotropic etching and it enables the formation of well-defined channels in the silicon wafers, which is not possible with any other silicon fabrication methods. The techniques for the creation of silicon materials involving etching several silicon wafers which are then united in an extremely accurate manner is particularly desirable for formation of print heads as the distance between the nozzles of the print heads must be accurately controlled.

Figures 6A, 6B, 6C, 6D, 6E, 6F, 6G, 6H:
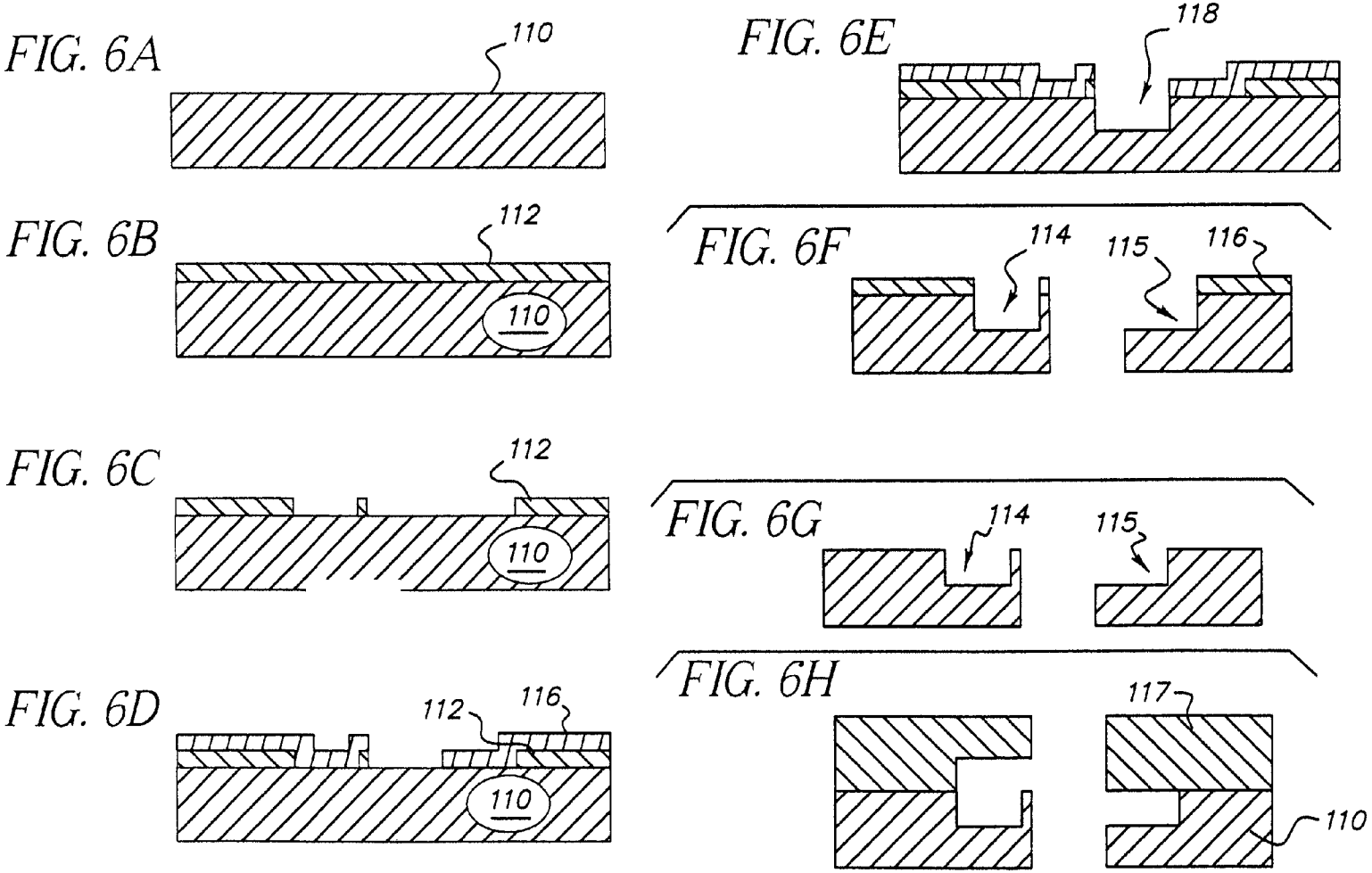
FIGS. 6A-6I are cross-sectional views of a fabrication process for AJ and by silicon wafers.
Figure 6I:
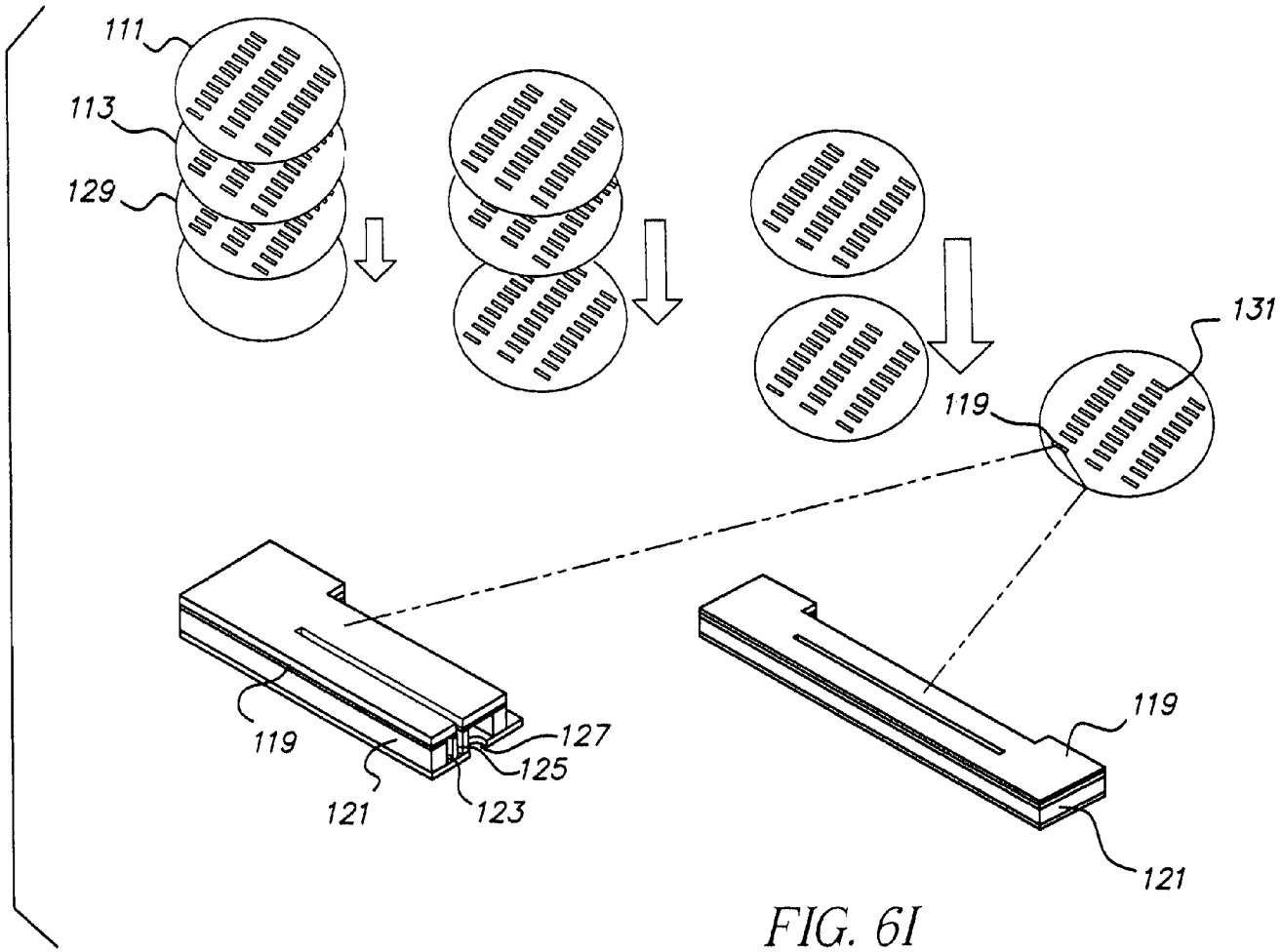

The methods and apparatus for formation of stacked chip materials are well-known. In FIGS. 6A-6I there is given a brief illustration of the manufacturing process. In FIG. 6A there shown a single wafer 110 that has no features etched into it. FIG. 6B shows a layer of silicon dioxide that was deposited on the silicon wafer surface via a plasma enhanced chemical vapor deposition process(PECVD. In FIG. 6C the oxide layer has been patterned using photolithography to define partially etched areas. In FIG. 6D the surface has been coated with a pattern of photoresist 116 on the side to be etched to define the openings in the photoresist where etching is to take place. In FIG. 6E the wafer 110 has been partially etched utilizing deep reactive ion etch process using the photoresist mask. In FIG. 6F after further etching has been carried out there is formed a hole 115 through the wafer as well as removed part of the wafer at 1 14. In FIG. 6G the oxide film has been removed to recover a formed wafer that will be one layer of a monolithic structure. In FIG. 6H another wafer 117 is adhered to wafer 112. Silicon wafer 117 had already been etched by the same process. In FIG. 6I there is a perspective expanded view of the fabrication of an integral gutter device via wafer scale integration. As illustrated there are etched wafers 111, 113, and 229 that are joined to form a wafer stack 131 that is a monolithic structure wherein openings have been formed by the individual etchings in the separate wafers 111, 113, and 115. The printhead 119 is then cut from the combined wafer stack and fastened to manifold 121. It can be seen that manifold 121 has openings 123 and 125 which would be channels for air in and out to be supplied to the printhead. Opening 127 would be an orifice in the manifold to bring fluids to the manifold or to provide suction. It is noted that FIG. 6I is only illustrative. The printhead of the invention would generally require at least six layers of wafers with etching to form the needed channels for the dual gutter integral printhead.

Figure 7:
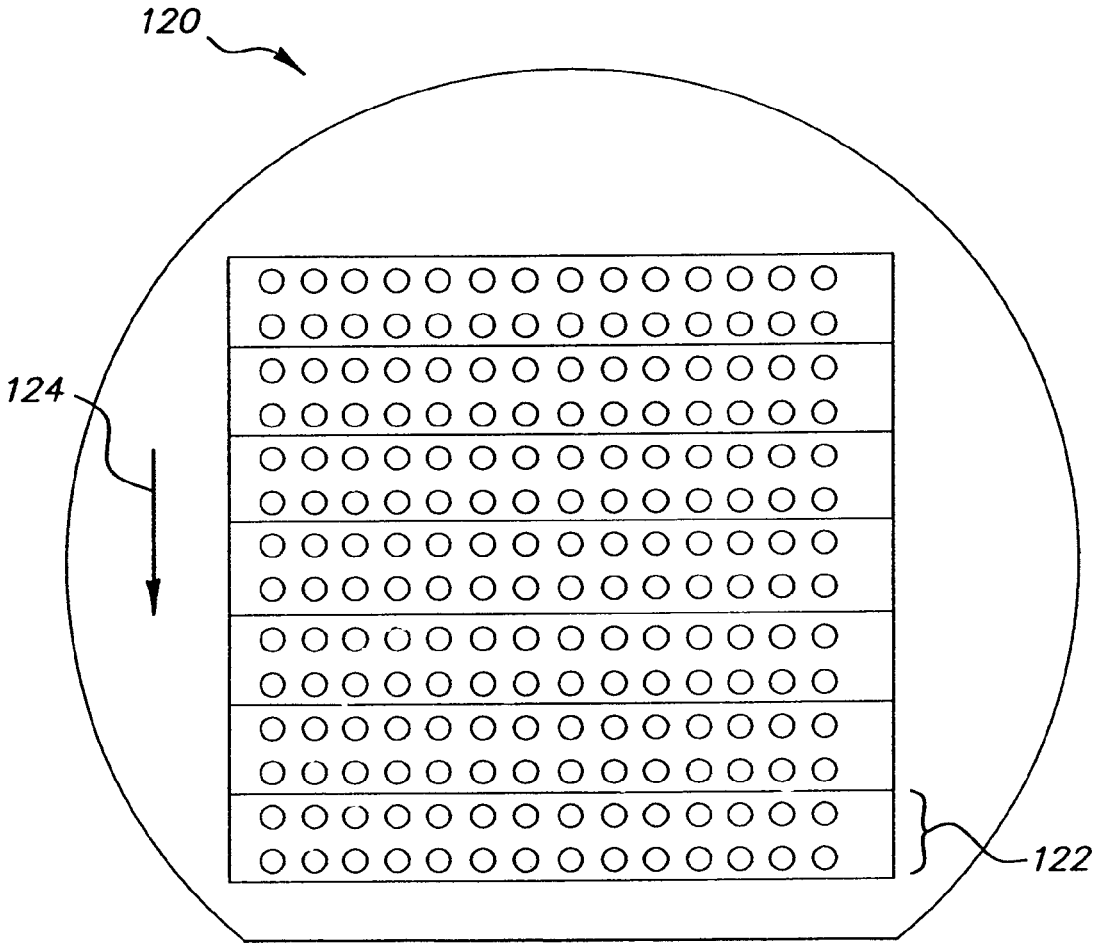
FIG. 7 is an illustration of a silicon wafer containing redundant rows of printheads for dual gutter devices.

In FIG. 7 there is illustrated a silicon wafer 120 where the rows of holes have been formed such that each printhead formed 122 is provided with dual rows of holes in alignment to the paper path when it is in use. The printheads from wafer 120 would be utilized with paper passing in the direction indicated by arrow 124 so that the pairs of holes would be aligned and formed at about 600 orifices per inch in each row. The rows of holes would be spaced from each other in the paper direction by distance of between about 1 mm to 10 mm. A preferred spacing would be between 4 to 6 mm as this spacing provides a few msec between the arrival of adjacent drops, which is a reasonable time to avoid drop-to-drop coalescence, while at the same time, the distance between nozzles is not so far apart that the paper stretches enough to cause drop-to-drop misalignment. It is understood that the illustration in FIG. 7 is not to scale and is only intended as illustrative of the nozzle pattern.

Figure 8:
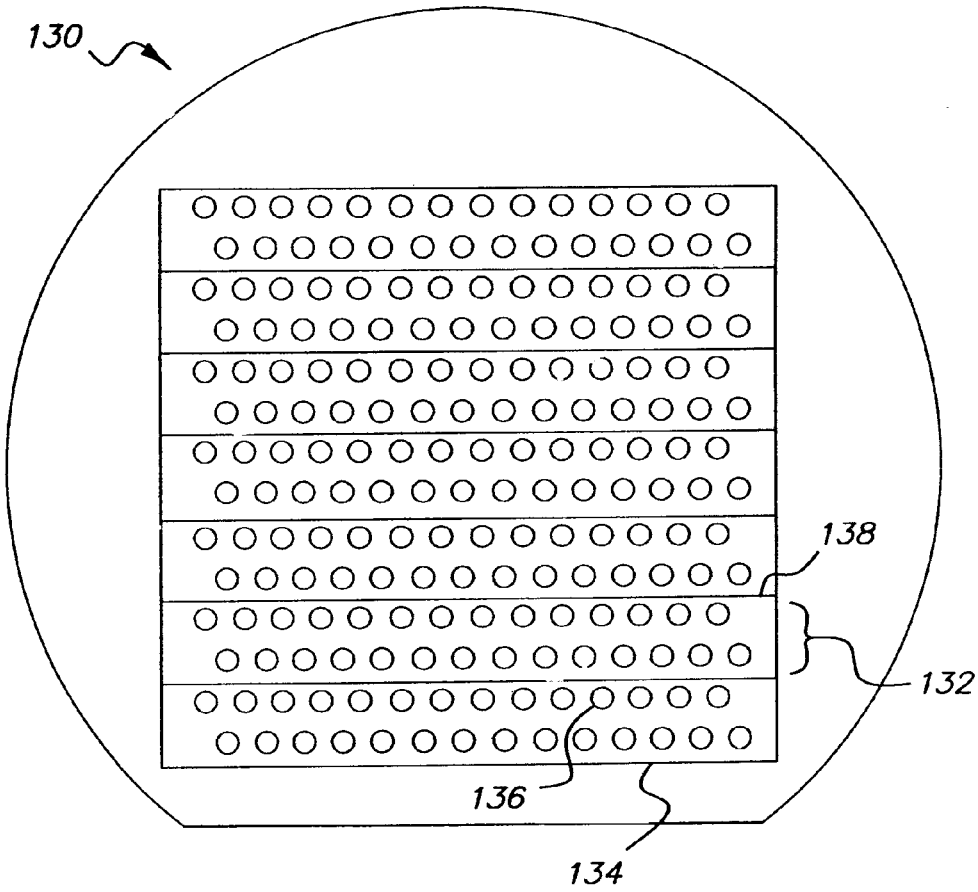
FIG. 8 is an illustration of a silicon wafer containing offset nozzles in a dual gutter device of the invention.

In FIG. 8 is illustrated the offset nozzle pattern. This pattern provides precise alignment and spacing of the nozzles because it is done photolithographically. As discussed above it has been impossible to form a unitary nozzle that provided 1200 nozzles per inch spacing because the diameter of the four pico liter droplets in the air is nearly equal to the nozzle pitch, which is about 21 μm. The nozzles as illustrated in FIG. 8 are offset by half of the distance between the nozzles or 0.5 of the pitch. The wafer 130 is illustrated as containing seven integral gutter dual role print heads. Each printhead such as 132 contains two rows of nozzles that are offset. Each row has 600 nozzles per inch and the two rows are offset by half the nozzle pitch, pitch being the distance between nozzles. The printhead 132 contains two rows of nozzles 134 and 136. The nozzles are released by cutting between the pairs on lines 138 to form the printhead. The spacing between the rows of nozzles may be any spacing that results in good print quality. Separation of the rows by too great a distance would introduce the problems discussed above of the paper changing properties after wetting by the first row of ink jets. The holes of a printhead having offset rows of holes in 600 nozzles per inch would be spaced from each other by distance of between 1 to 10 millimeters. A preferred spacing would be between 4 to 6 millimeters. The technique of silicon direct wafer bonding is well-known in the art. One disclosure is "A Study of Multi-stack Silicon-Direct Wafer Bonding for 3D MEMS Manufacturing" in our by N. Miki et al. presented at the 15$^{th}$ IEEE MEMS Conference, Jan. 20-20 4, 2002, Las Vegas, Nev., USA and the references listed therein.

When a curtain of closely packed drops are subjected to a crossing air current, the drops experience a phenomenon called splay which is discussed in U.S. patent application Ser. No. 11/687,873 filled Mar. 19, 2007, titled "Aerodynamic Error Reduction for Liquid Drop Emitters". One way to reduce the splay effect is to increase the spacing between the drops. A dual gutter structure can be used to minimize the splay effect by simply providing two rows of nozzles at 300 npi spacing instead of the single row of 600 npi spacing. Distance between drops will now be 84.66 microns from 42.33 microns, which is sufficient to make splay insignificant.

While the invention has been discussed with one silicon chip containing dual gutters and dual rows of nozzles, it is within the invention that other structures with additional rows of nozzles would be possible. For instance a silicon printhead structure could be fabricated with four rows of nozzles and four gutters. This could be done by slicing the fabricated wafer to separate four rows of nozzles and their corresponding gutters, instead of two, and constructing a manifold that has the ability to supply four rows of offset nozzles. It is conceivable that even more rows could be formed up to the maximum size of wafer formation. Further, while the gutters are shown on the exterior sides of the wafers outside of the nozzles and ink streams, it is within the invention that a chip could be formed with the airflow for deflecting air in the opposite direction such that gutters and suction for ink removal would be on the area between the nozzles. Such a system would have the deflection of the ink streams in opposite directions toward the interior rather than the exterior of the printhead shown in FIG. 4A. It is also possible that the dual rows of nozzles and gutters such as illustrated in the drawing could be combined in a single monolithic silicon printhead with a further single row of nozzles to form a printhead having three rows of nozzles. The addition of a single gutter and nozzle to the printhead would achieve three rows of nozzles on a printhead. It is apparent that any number of nozzles could be formed by the fabrication techniques for silicon wafers. A difficulty with multiple integral silicon inkjet nozzle rows is the small space available to supply the electronics, fluids and gas to the nozzles. It may be necessary to utilize the silicon wafer fabrication techniques to manufacture the manifolds to lead the sources of 10, air, suction and electronics to each row of print heads of the invention.

The invention has been described in detail with particular reference to certain preferred embodiments thereof, but it will be understood that variations and modifications can be effected within the spirit and scope of the invention.

PARTS LIST

10 nozzle plate
12 nozzle
12 bores
14 dielectric membrane
16 substrate
18 ink channels
21 cross bars
22 jet stream
26 manifold
32 ink
34 droplets
40 printhead
42 stream
44 airstream
46 smaller drops
48 larger drops
49 catcher
52 sump
60 ink jet head
62 orifices
64 orifices
66 small drops
68 large drops
69 channel
72 channel
74 channel
76 gutter
77 gutter
78 wall
81 opening
82 duct
83 opening
84 duct
86 duct
88 duct
90 wafer
92 heaters
92 bracket
94 line
98 channels for air
99 ink returns
110 wafer
111 wafer
112 oxide layer
113 wafer
114 removed area
115 hole
116 photoresist
117 wafer
119 printhead
120 wafer
121 manifold
122 printhead
123 opening
125 opening
127 opening
129 wafer
130 wafer
131 stock wafer
134 nozzles
136 nozzles
138 lined
140 exit opening
142 ink
143 ink
143 meniscus
144 opening
146 ink
148 ink
152 wall
154 wall top

The invention claimed is:

1. A continuous inkjet printing apparatus comprising a dual row of ink orifices from which streams of liquid are emitted that break into drops in a monolithic integral gutter inkjet printhead, the printhead including a plurality of integral gutters, one of the plurality of integral gutters corresponding to one of the rows of ink orifices and being positioned to collect some of the drops formed from the liquid streams emitted from the one row of ink orifices, the other of the plurality of integral gutters corresponding to the other row of ink orifices and being positioned to collect some of the drops formed from the liquid streams emitted from the other row of ink orifices.

2. The inkjet printing apparatus of claim 1 wherein one row of ink orifices is offset from the other row.

3. The inkjet printing apparatus of claim 2 wherein each row has approximately an equal number of nozzles and each row is offset by one half of the pitch of the rows.

4. The inkjet printing apparatus of claim 2 wherein each row of orifices has about 600 nozzles per inch.

5. The inkjet printing apparatus of claim 1 wherein the orifices of the rows are offset by between 0 and 21.167 micrometers.

6. The inkjet printing apparatus of claim 1 wherein the rows are spaced between 1 and 10 millimeters apart.

7. The inkjet printing apparatus of claim 1 wherein the orifices of each row are aligned in a direction of recording medium movement during operation of the apparatus.

8. The inkjet apparatus of claim 1 wherein the rows are spaced apart by an amount of between 4 and 6 millimeters.

9. The inkjet apparatus of claim 1 wherein each integral printhead has 600 or more orifices.

10. The inkjet apparatus of claim 1 wherein the integral gutters are integrally formed with the dual rows of ink orifices.

11. The inkjet apparatus of claim 1 wherein each integral printhead incorporates heaters, inkjet orifices, gutters, openings for injection of deflection air and openings for collinear air.

12. The inkjet apparatus of claim 1 wherein said integral printhead has a thickness between 1 and 6 millimeters.

13. The inkjet apparatus of claim 12 wherein said integral printhead has a width of between 5 and 20 millimeters.

14. The inkjet apparatus of claim 13 wherein said integral printhead has a length of between 10 and 600 millimeters.

15. The inkjet apparatus of claim 1 wherein the dual row of inkjet orifices share an inkjet supply channel.

16. The inkjet printing apparatus of claim 1 wherein each row of the dual rows of ink orifices is associated with a corresponding deflection system.

17. The inkjet printing apparatus of claim 16 wherein each deflection system includes channels for air that deflects the drops.

18. The inkjet printing apparatus of claim 16 wherein the channels are positioned such that the drops are deflected in opposite directions.

19. An inkjet printing apparatus comprising a dual row of ink orifices in a monolithic integral gutter inkjet printhead wherein the dual row of inkjet orifices share an inkjet supply channel and wherein said integral printhead further provides gutters, channels for suction from the gutters, deflection air channels and collinear air channels.

20. An inkjet printing apparatus comprising a dual row of ink orifices in a monolithic integral gutter inkjet printhead wherein the dual row of orifices share deflection air supply channels.

21. The inkjet apparatus of claim 20 wherein said dual row of orifices shares a channel for deflection air supply and a collinear air supply channel.

22. An inkjet printing apparatus comprising a dual row of ink orifices in a monolithic integral gutter inkjet printhead and a deflection air supply that is directed to each row of orifices from a common supply channel with air being supplied to the ink streams ejected from each orifice from opposite directions.

23. The inkjet apparatus of claim 22 wherein the deflection air is directed away from the area between the dual rows of inkjet orifices to gutters located outside of the dual row of inkjet orifices.

24. The inkjet printing apparatus of claim 1 wherein said integral printhead comprises an additional row of ink orifices.

25. The inkjet printing apparatus of claim 1 wherein said integral printhead comprises an additional two rows of ink orifices and an additional two gutters.

* * * * *